US006726606B2

(12) United States Patent
Jacobsen

(10) Patent No.: US 6,726,606 B2
(45) Date of Patent: Apr. 27, 2004

(54) AEROBIC EXERCISE APPARATUS

(75) Inventor: Neill Jacobsen, 3222 Long Iron Pl., Lawrenceville, GA (US) 30044

(73) Assignee: Neill Jacobsen, Phoenix, AZ (US)

( * ) Notice: Subject to any disclaimer, the term of this patent is extended or adjusted under 35 U.S.C. 154(b) by 113 days.

(21) Appl. No.: 09/982,292

(22) Filed: Oct. 18, 2001

(65) Prior Publication Data

US 2003/0078142 A1 Apr. 24, 2003

(51) Int. Cl.[7] ..... A63B 21/00
(52) U.S. Cl. ..... 482/121; 482/907; 482/124
(58) Field of Search ..... 482/124, 126, 482/129, 102, 122, 907, 121–130, 94; 248/188, 7; 601/35, 33, 34

(56) References Cited

U.S. PATENT DOCUMENTS 629,655 A * 7/1899 Bryon ..... 482/121
735,065 A * 8/1903 Chellis ..... 482/121
5,885,190 A * 3/1999 Reiter ..... 482/124

* cited by examiner

*Primary Examiner*—Jerome W. Donnelly

(57) ABSTRACT

An exercise apparatus utilizing a set of Legs elastic cords and a set of Arms elastic cords.

The Aerobic exercise apparatus includes a pair of Legs adjustable extensions, connected to the Legs elastic cords and, to the pair of legs harness.

The Aerobic exercise apparatus includes a door attachment and, an adjustable extension to connect to the Arms elastic cords.

A pair of legs harness and a pair of handles attached to the sets of elastic cords.

The Aerobic exercise apparatus includes sets of connective Snaps links and sets of connective Rings.

5 Claims, 13 Drawing Sheets

AEROBIC EXERCISE APPARATUS

NOTICE OF REFERENCES CITED

| Document no. | Date | Name | Class | Subclass |
|---|---|---|---|---|
| 4,109,907 | Aug. 29, 1978 | Zito | 482/94; 482/904 | |
| 4,733,862 | Mar. 29, 1988 | Miller | 482/126; 24/129R; 482/125; 482/129 | |
| 4,779,867 | Oct. 25, 1988 | Hinds | 482/126; 482/122; 482/904 | |
| 4,909,505 | Mar. 20, 1990 | Tee | 482/129; 482/121 | |
| 5,372,565 | Dec. 13, 1994 | Burdenko | 482/124; 482/55; 482/125; 482/126 | |
| 5,518,486 | May 21, 1996 | Sheeler | 482/131; 482/907; 482/139 | |
| 5,549,532 | Aug. 27, 1996 | Kropp | 482/126; 482/122; 482/124 | |
| 5,582,579 | Dec. 10, 1996 | Chism | 601/27; 482/79; 601/34; 602/36 | |
| 5,688,213 | Nov. 18, 1997 | Recker | 482/125; 482/139; 482/79 | |
| 6,267,711 | Jul. 31, 2001 | Hinds | 482/121; 482/129; 482/904 | |

BACKGROUND OF THE INVENTION

Field of the Invention

The invention is related to an aerobic exercise apparatus that include two pairs of elastic cords, a pair of legs adjustable extension,a door attachment that engages a door, a arm cord adjustable extension one pair of legs harness and, one pair of handles.

Such device is useful because is easy to use, is adjustable, can be use indoors or outdoors, and can be use when travel.

The user is using the elastic cord resistance which increases as the user stretches the elastic cords.

When more resistance is needed the user can add more elastic cords as desiered.

The increasing resistance provides a higher overall benefit for a variety of movements and specially for cardiovascular exercises.

The apparatus of the invention is an improvement over the exercising apparatus and methods described by the inventors in their prior patents, U.S. Pat. No. 4,109,907 Zito; U.S. Pat. No. 4,733,862 Miller; U.S. Pat. No. 4,779,867 Hinds; U.S. Pat. No. 4,909,505 Tee; U.S. Pat. No. 5,372,565 Burdenko; U.S. Pat. No. 5,518,486 Sheeler; U.S. Pat. No. 5,549,532 Kropp ; U.S. Pat. No. 5,582,579 Chism ; U.S. Pat. No. 5,688,213 Recker; U.S. Pat. No. 6,267,711 Hinds.

All prior patents are design to be use only for arms or only legs exercises.

The Aerobic exercise apparatus can be used for the arms and legs at the same time, performing a varieties of aerobic exercises.

One main advantage of this exercise apparatus is that the user can lay on the ground exrcising the arms and legs eliminating all the preasure put on the legs joints when doing standing conventional aerobic exercises.

The present invention relates to a novel and useful exercise apparatus and relates to human body training concern with training the muscle of the "core", of the body which primarily helps to stabilize the body during a normal activities such as moving, standing and sitting.

Unfortunately many apparatuses are not susceptible to use by persons of different heights or physical abilities.

An exercise apparatus using a set of elastic cords which are adjustable to accommodate person of different heights would be a notable advance in the physical conditioning of a large and various groups of muscles for total body training, conditioning and also physical therapy field.

SUMMARY OF THE INVENTION

In accordance with the present invention a novel and enhanced exercise apparatus is herein provided to satisfy the aforementioned needs.

The exercise apparatus of the present invention utilizes a set of elastic cords which provides a resistance force as the user is stretching the cords.

The exercise apparatus uses a pair of leg adjustable extensions.

The exercise apparatus uses a door attachment that engages a door, a tree or a bed leg.

The apparatus of the present invention also includes, an arm adjustable extensions.

The exercise apparatus of the present invention also includes one pair of leg harness and one pair of handles.

The apparatus of the present invention also includes sets of Spring Snaps, Bolt Snaps, "D" rings or "O" rings used to connect the elastic cords.

The resistance force may be provided by the elastic cords as the user is stretching the elastic cords while the user can stand, lay or sit on the ground.

It may be apparent that a novel and useful exercise apparatus has been described.

It is therefore an object of the present invention to provide an exercise apparatus that utilizes a set of elastic cords that are connected to a door attachment which engages a door or other conective element.

Another object of the present invention is to provide an exercise apparatus using an adjustable extension which is adjustable for users of different height while the user is standing, siting or lying on the floor.

Yet another object of the present invention is to provide an exercise apparatus which is compact and easy to assemble and use.

A further object of the present invention is to provide an exercise apparatus which employs a set of elastic cords and a multiplicity of supports permitting the use of the exercise apparatus in various conditioning and therapeutic situations.

Yet another object of the present invention is to provide an exercise apparatus which provides a set of elastic cords permitting the use of the arms and legs at the same time; for the conditioning of major muscle groups at the same time.

Yet another object of the present invention is to provide an exercise apparatus which provides a set of elastic cords permitting the use of the legs for the conditioning of the legs major muscle groups.

Another object of the present invention is to provide an exercise apparatus which provides a set of elastic cords permitting the use of the arms and legs for the conditioning of the arms, legs and other body major muscle groups.

Yet another object of the present invention is to provide an exercise apparatus which provides a set of elastic cords, permitting the user to stand, sit or lay on the ground and permitting the use of the arms and legs for the conditioning of the arms, legs and other body major muscle groups, in a lateral or bilateral movement.

Another object of the present invention is to provide an exercise apparatus on which the user can perform a varieties of aerobic exercises.

The invention possesses other objects and advantages especially as concerns particular characteristics and features thereof, which will become apparent as the specification continues.

DESCRIPTION OF THE PREFERRED EMBODIMENTS

Figure 1:
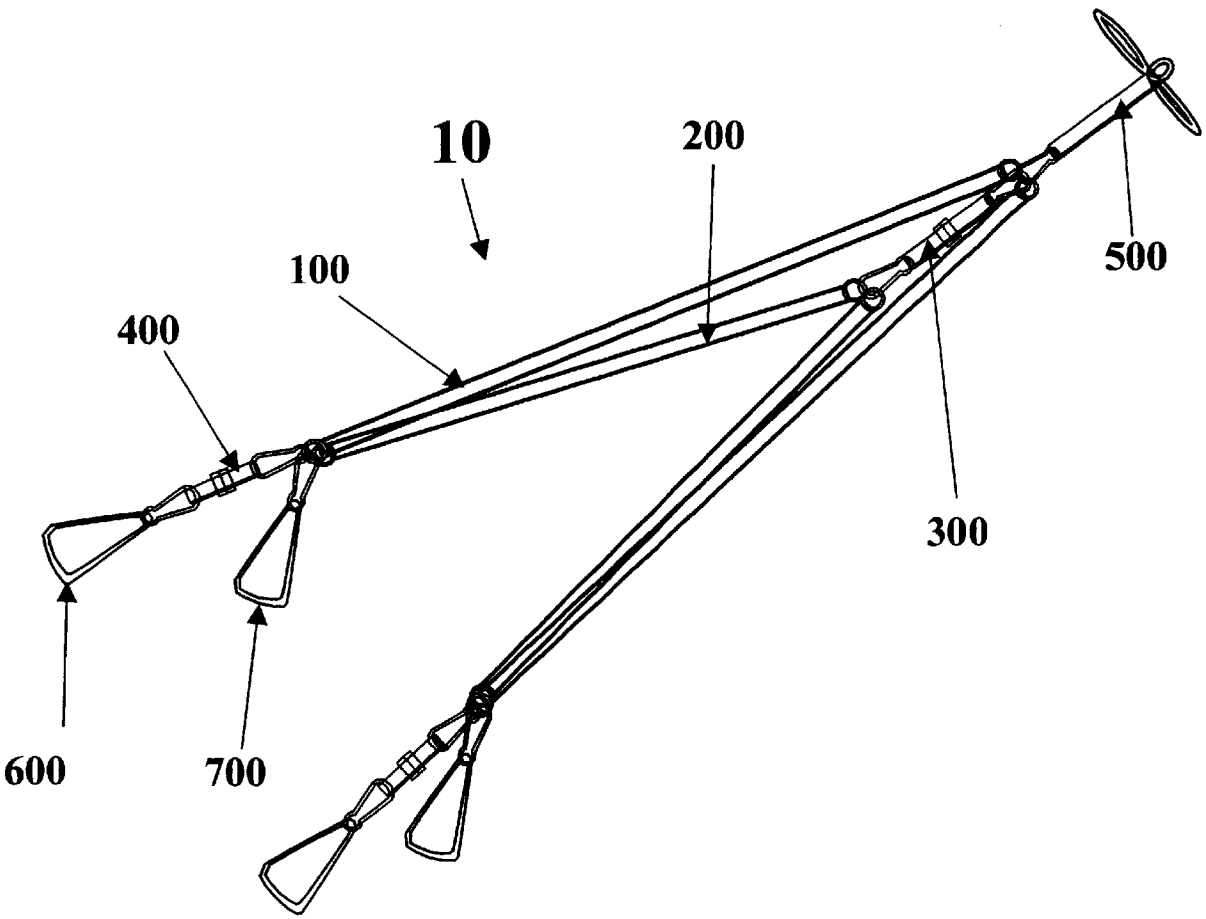
FIG. 1 is an isometric view of an embodiment of the apparatus "10" of the present invention.
Figure 2:
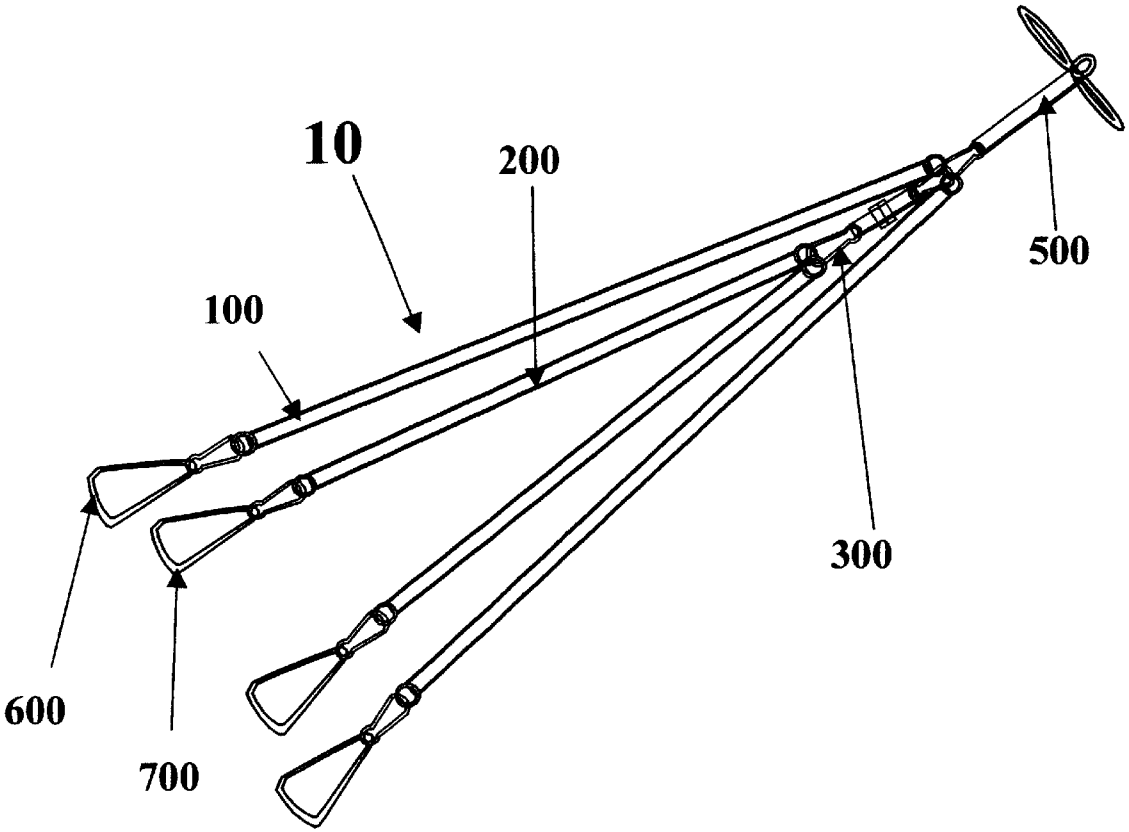
FIG. 2 is an isometric view of an embodiment of the apparatus "10" of the present Invention without legs adjustable extension.
Figure 3:
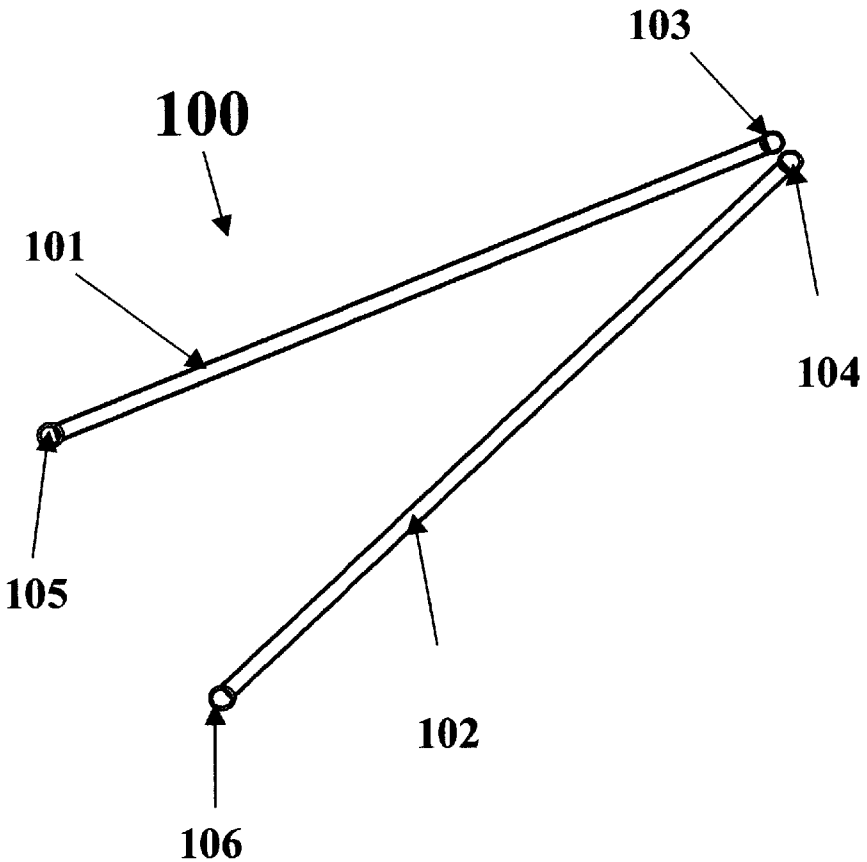
FIG. 3 is an isometric view of the Legs elastic cords "100" of the present invention.
Figure 4:
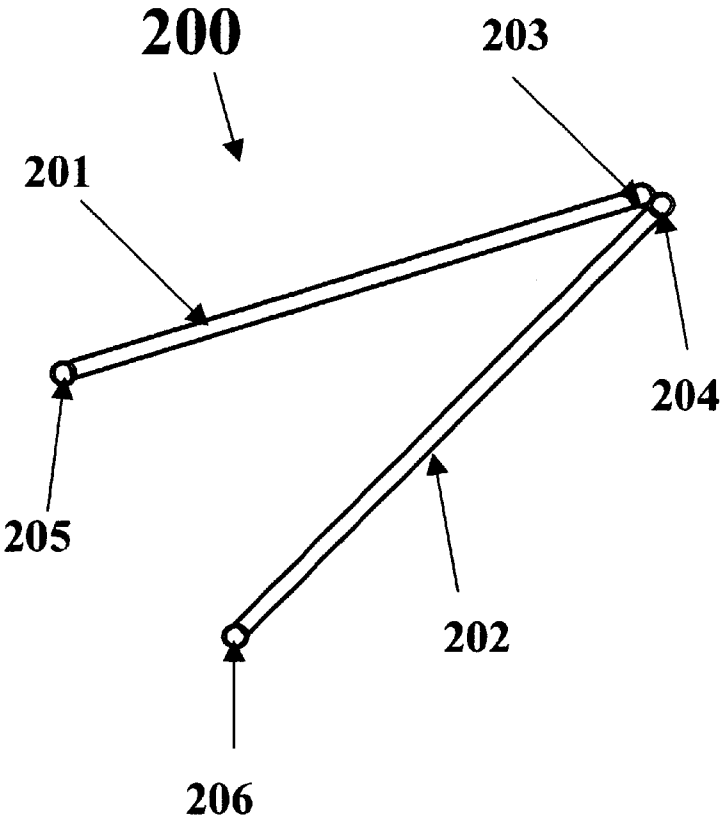
FIG. 4 is an isometric view of the Arms elastic cords "200" of the present invention.

Various aspects of the present invention will evolve from the following detailed description of the preferred embodiments thereof which should be referenced to the herein above described drawings.

In the following description, like reference characters designate like or corresponding parts throughout the several views of the drawings. Also in the following description, it is to be understood that such terms as "front rear upper lower left right", and the like, are words of convenience and are not to be construed as limiting terms.

Referring to the drawings, and particularly to FIGS. 1–9 there is shown an enhanced aerobic exercise apparatus, generally designated 10, incorporating all improved features of the present invention.

The apparatus as a hole is depicted in the drawings by reference character 10. Apparatus 10, incorporates seven major embodiments (as viewed in FIG. 1, through FIG. 9)

The first major embodiment is the "Legs Elastic Cord assembly" 100 which include two Elastic Cords 101 and 102 connected to the Rings 103, 104, 105 and 106(as viewed in FIG. 3), which is also referred to as a pair of first elastic cord members.

The Legs Elastic Cords 101 and 102 are connected at one end to the Door Attachment 501 by a Snap link 502.

The Legs Elastic Cords 101 and 102 are connected at the other end to the pair of Legs Harness 601 by a pair of Snap links 604.

The second major embodiment is the "Arms Elastic Cord assembly" 200 which include two Elastic Cords 201 and 202 connected to the Rings 203,204,205 and 206(as viewed in FIG. 4), which is also referred to as a pair of second elastic cord members.

The Arms Elastic Cords 201 and 202 are connected at one end to the Arms adjustable extension strap 301 by a Snap link 303. Further the Arms adjustable extension strap is conected to the Door Attachment 501 by a Snap link 302.

The Arms Elastic Cords 201 and 202 are connected at the other end to the pair of Handles 701 by a pair of Snap links 205 and 206.

Figure 5:
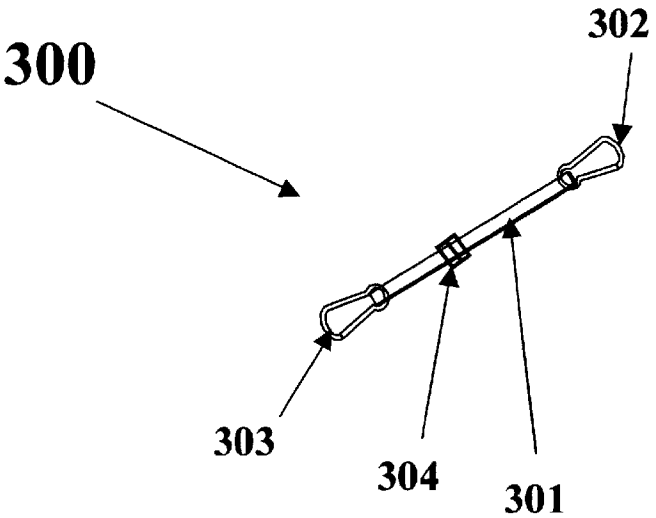
FIG. 5 is an isometric view of the arms adjustable extension "300" of the present invention.

The third major embodiment is the "Arms adjustable extension assembly "300" which includes a webbing strap 301 connected to the Snap links 302 and 303 (as viewed in FIG. 5).

The Arms adjustable extension 301 is connected at on end to the Door attachment 501 by the Snap link 302 and, to the other end connected to the Arms Elastic Cords 201 and 202 by the Snap link 303.

The adjustable extension 301 it is adjusted by the slide 304.

Figure 6:
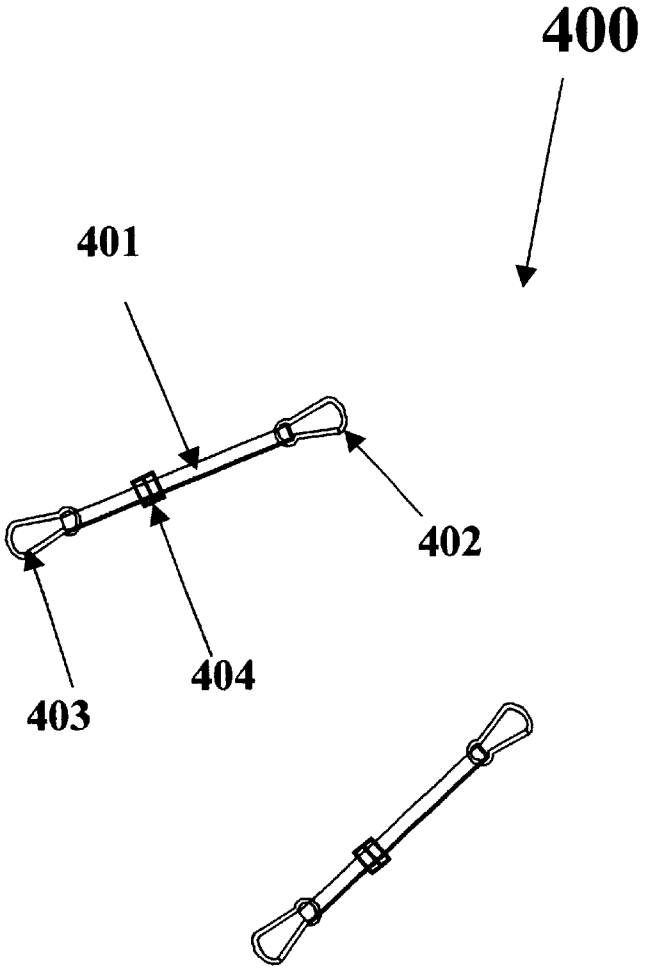
FIG. 6 is an isometric view of the legs adjustable extension "400" of the present invention.

The forth major embodiment is the "Legs adjustable extension "400" which include two webbing strap 401 (as viewed in FIG. 6).

The Legs adjustable extension 400 is connected at on end to the Legs elastic cords 101 and 102 by the pair of Snap links 402 and, to the other end connected to the pair of Legs harness 601 by the pair of Snap links 403.

The adjustable extension 401 it is adjusted by the slide 404.

Figure 7:
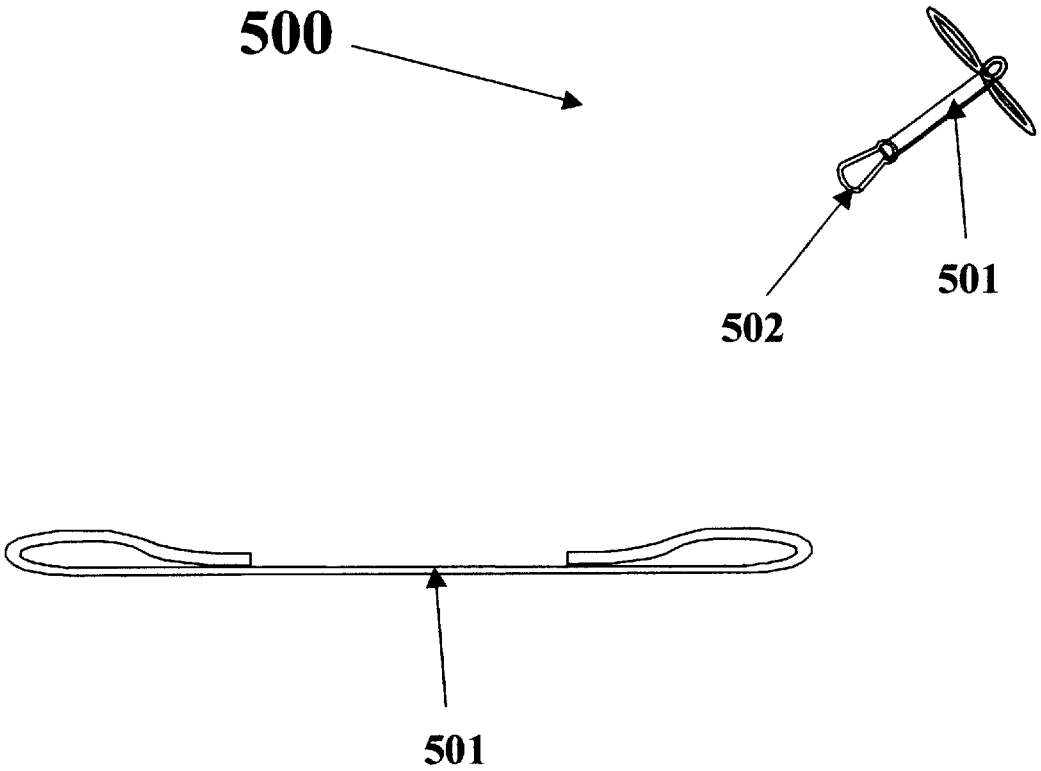
FIG. 7 is an isometric view of the door attachment "500".

The fifth major embodiment is the "Door attachment assembly "500" which include one webbing strap 501 (as viewed in FIG. 7).

The Door attachment comprises of a webbing strap having a permanent formed loop at each end by means of sewing.

The Door attachment can be attached to the door knob by forming a loop or to the upper or side door gap by tying the webbing strap 501 in a bow as shown in FIG. 7 This will cause the webbing strap 501 to remain on the opposite side of the door and provide a solid anchor for the exercise apparatus.

Figure 8:
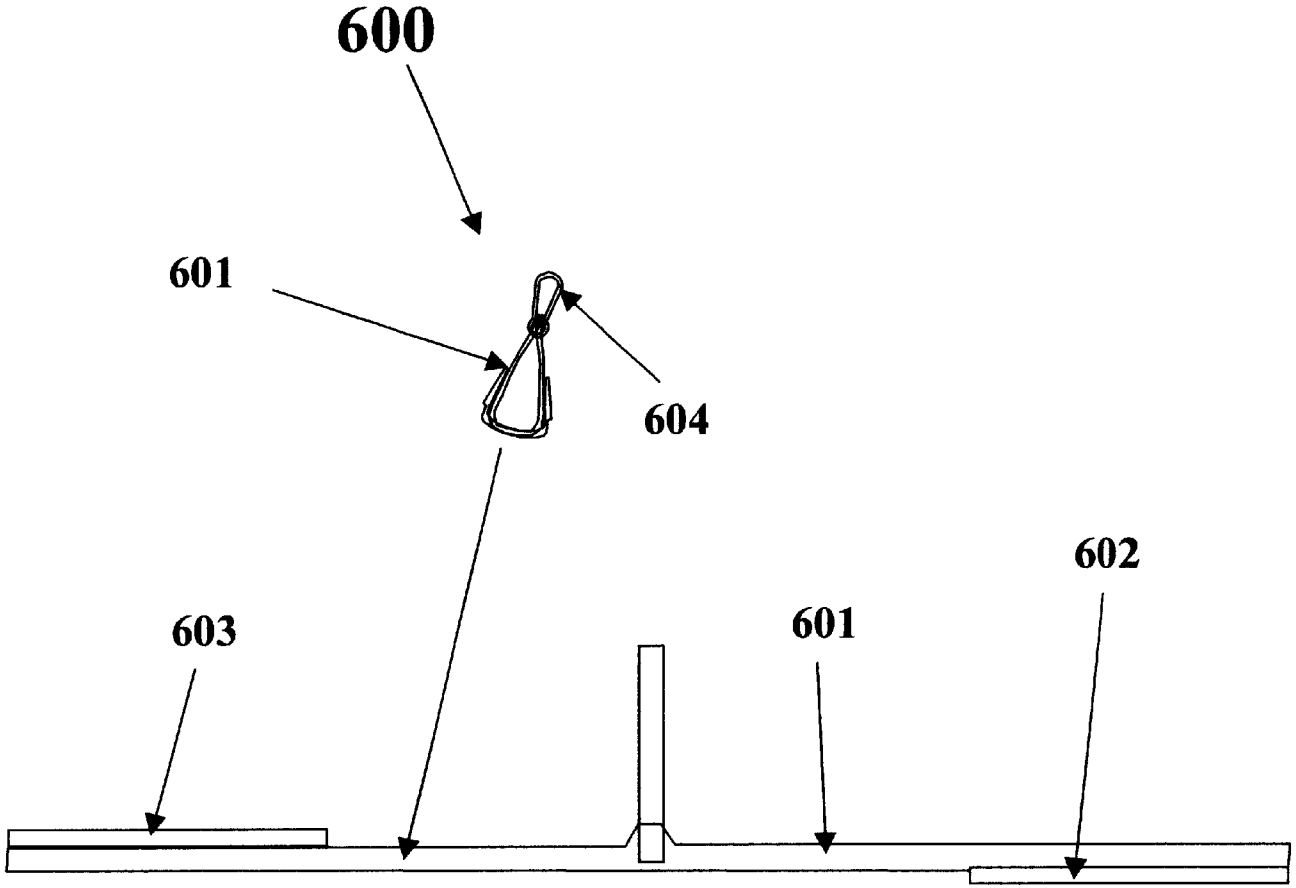
FIG. 8 is an isometric view of the Legs harness "600".

The sixth major embodiment is the "Leg harness assembly "600" which include a pair of webbing straps 601 connected by velcro straps 602 and 603 (as viewed in FIG. 8).

The Legs harness 601 are connected to the Leg elastic cord 101 and 102 by a pair of Snap links 604.

The Legs harness 601 are connected to the user by forming a cross loop around the foot and, closed by velcro straps 602 and 603.

Figure 9:
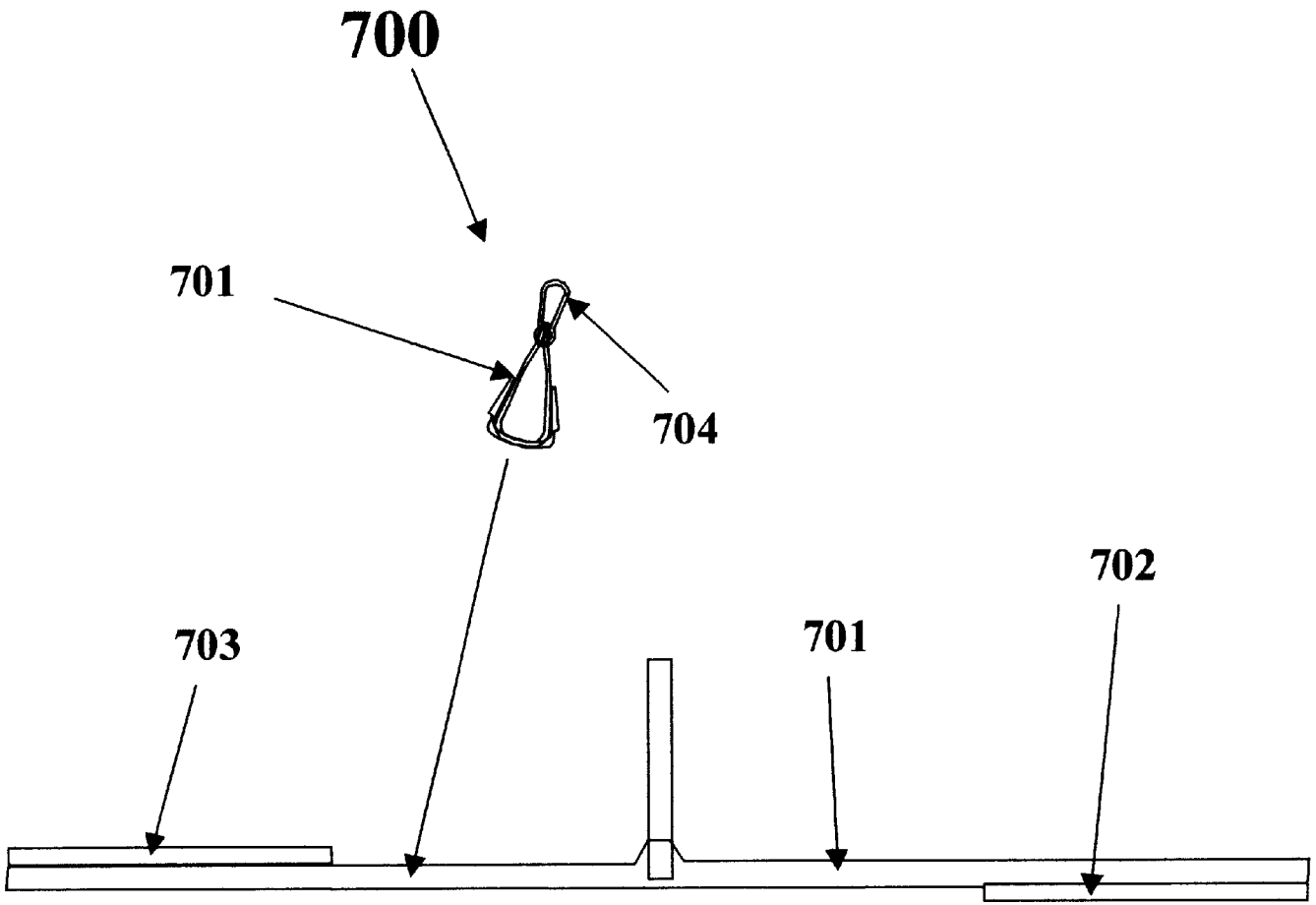
FIG. 9 is an isometric view of the handles "700".
Figure 10:
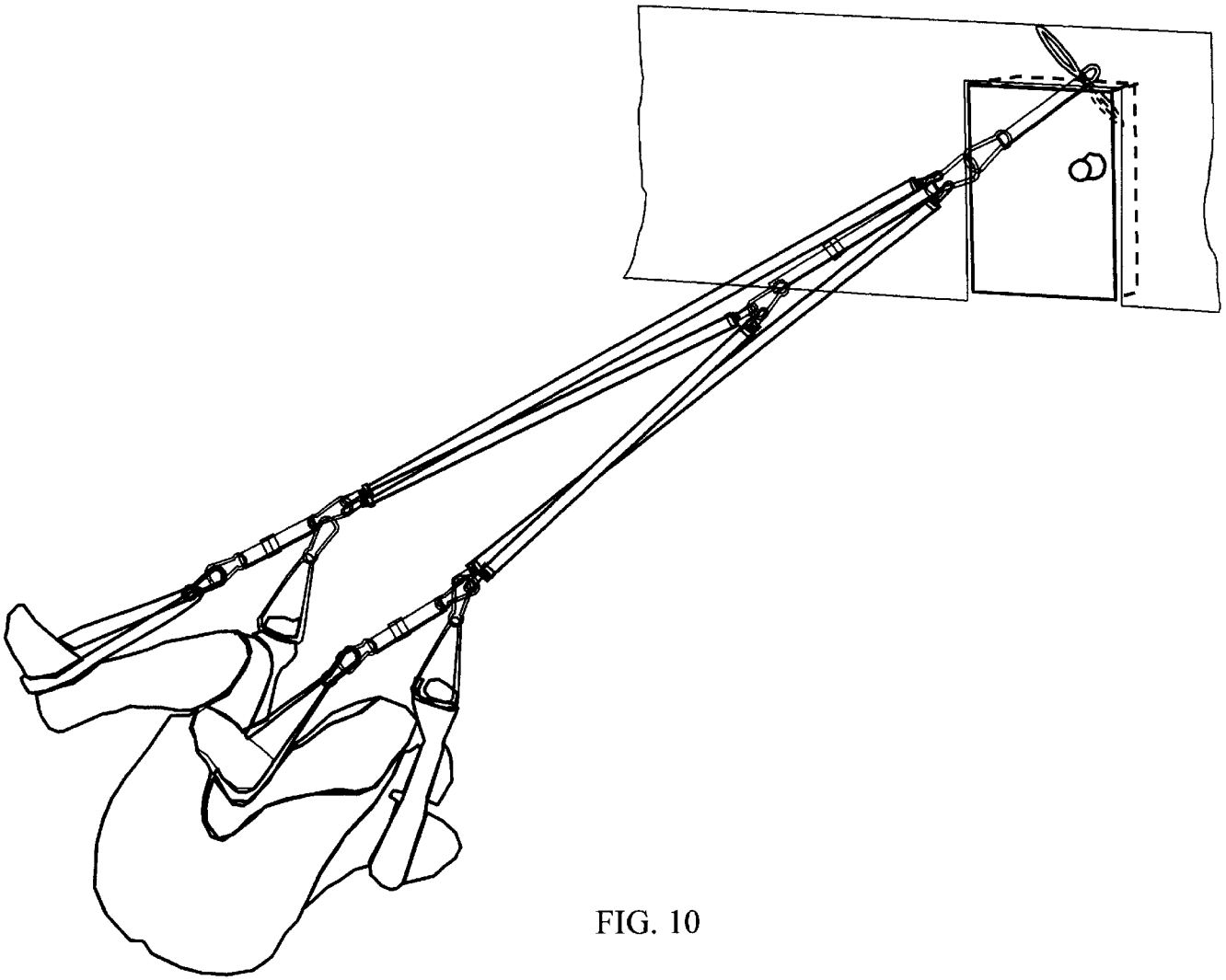
FIG. 10 is an isometric view of an embodiment of the apparatus "10" showing an aerobic exercise in a laying position of the present invention.
Figure 11:
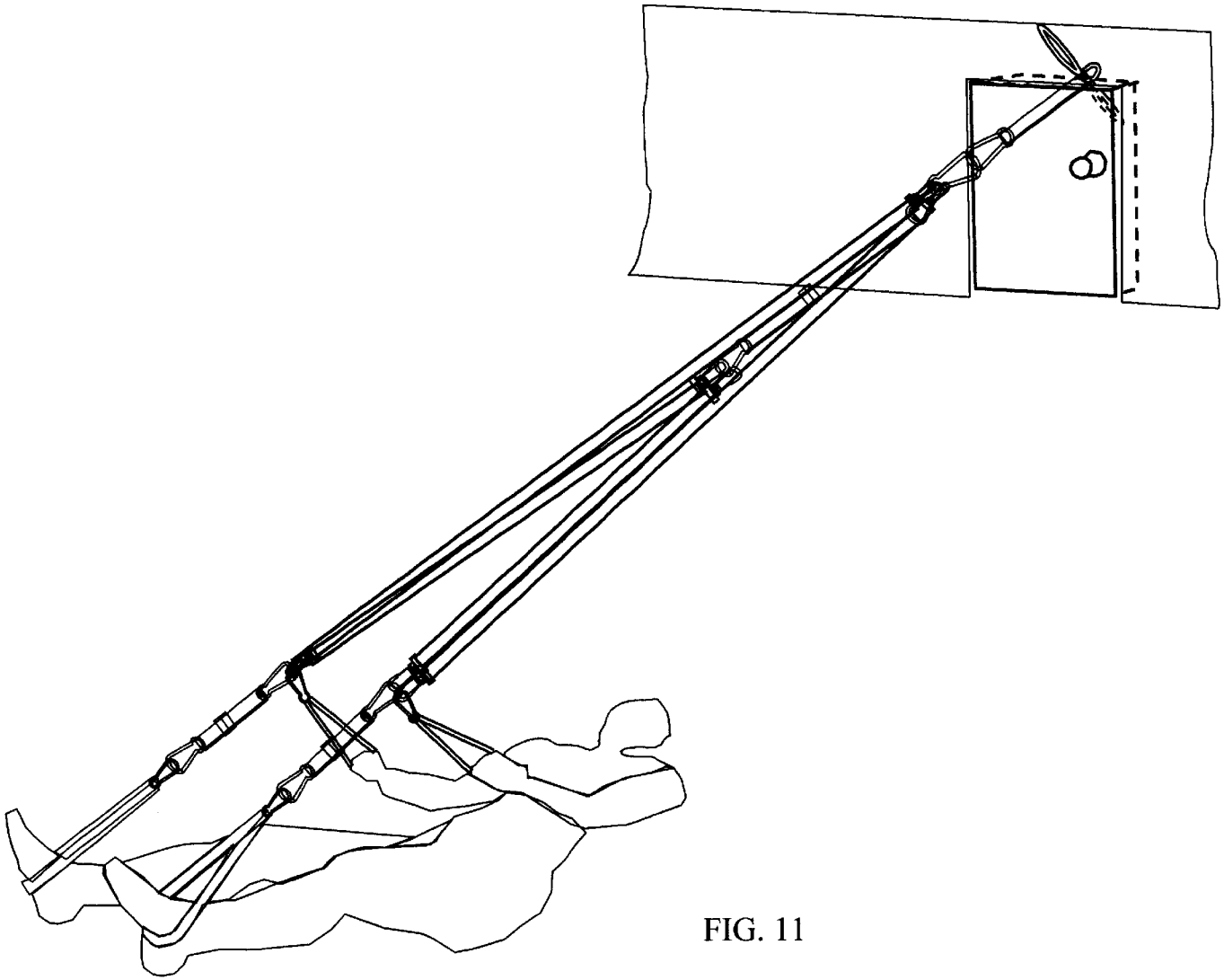
FIG. 11 is an isometric view of an embodiment of the apparatus "10" showing an aerobic exercise in a laying position of the present invention.
Figure 12:
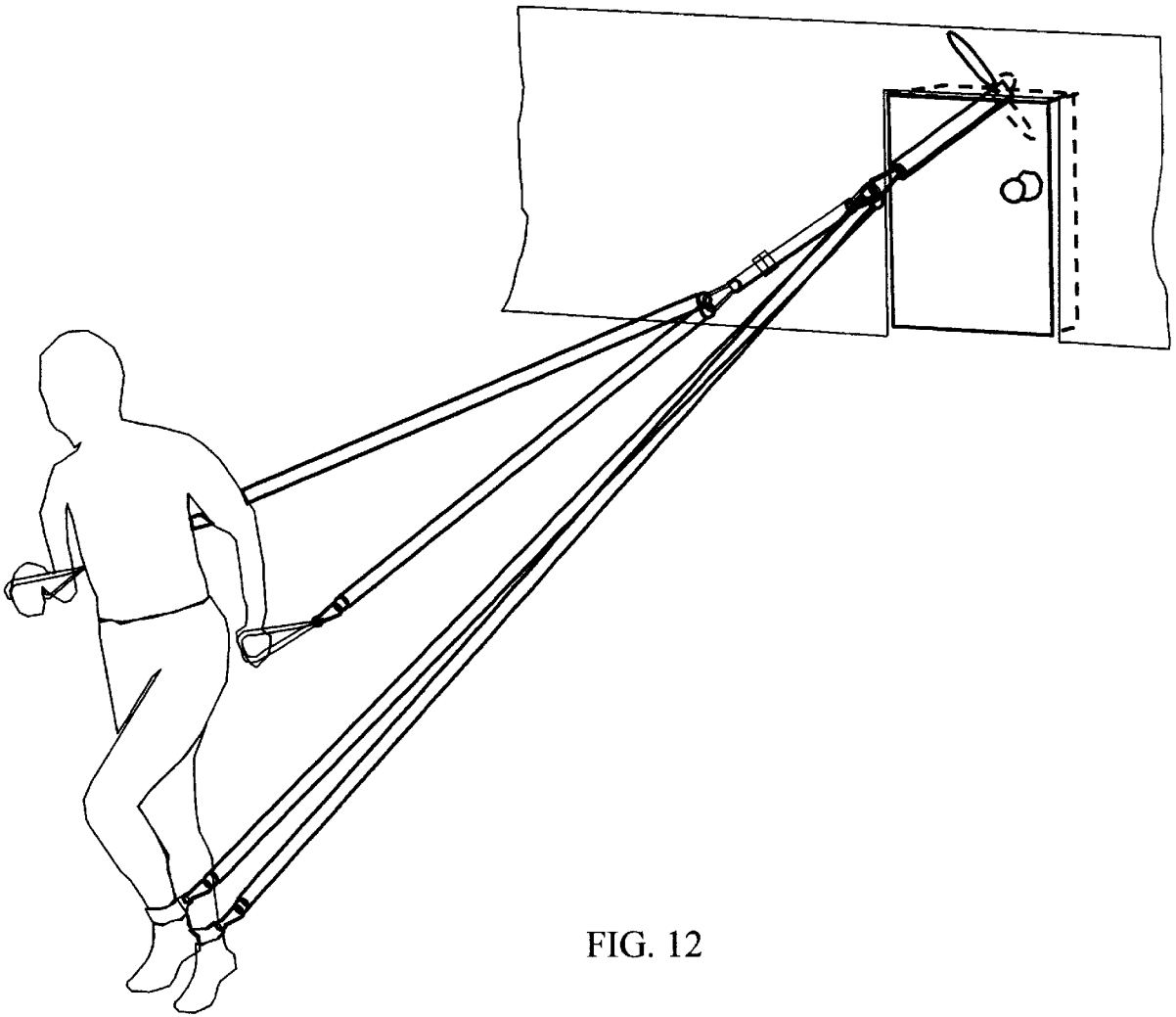
FIG. 12 is an isometric view of an embodiment of the apparatus "10" showing an aerobic exercise in a standing position of the present invention.
Figure 13:
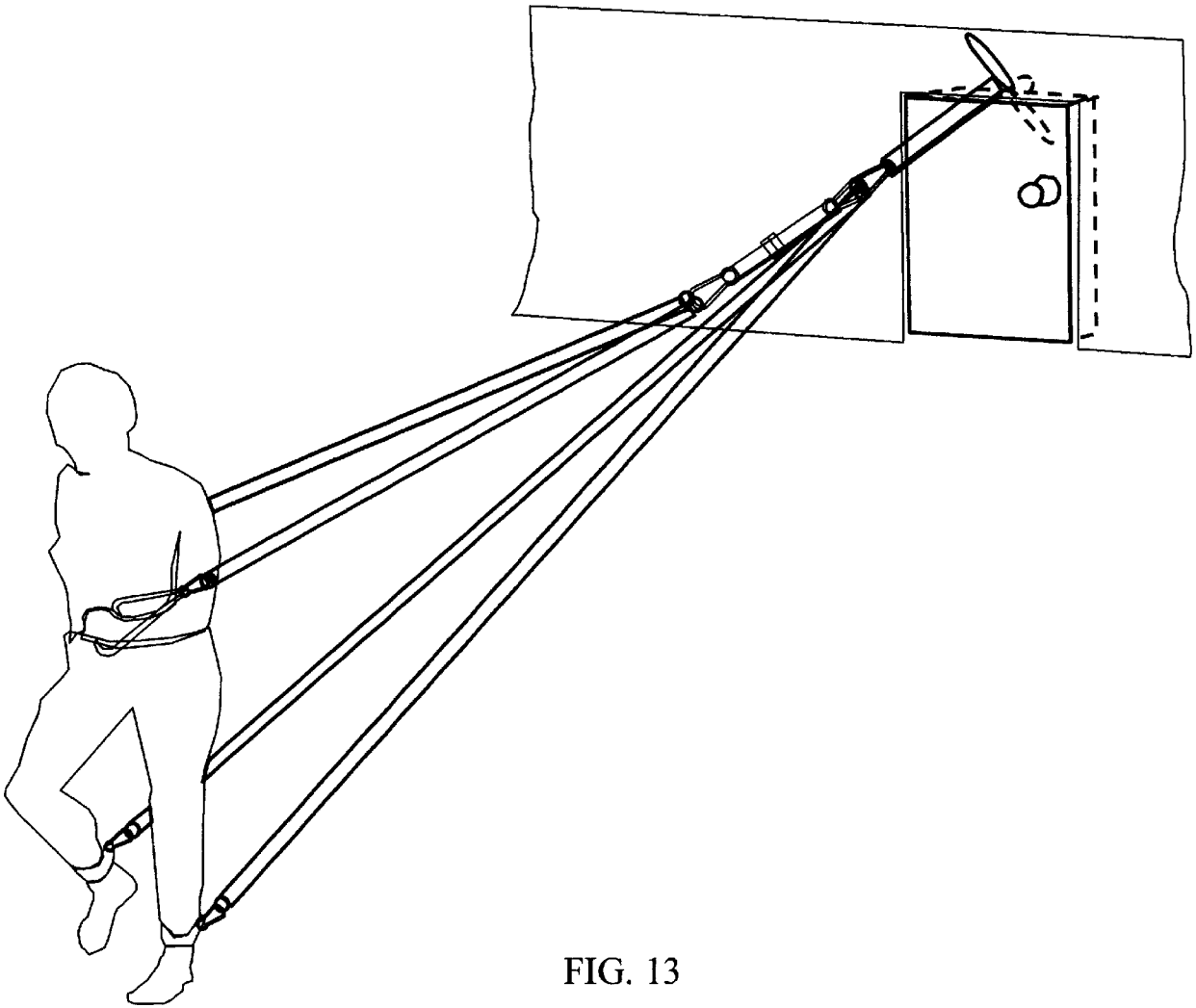
FIG. 13 is an isometric view of an embodiment of the apparatus "10" showing an aerobic exercise in a standing position of the present invention.

The seventh major embodiment is the "Handle assembly "700" which include a pair of webbing straps 701 connected by velcro straps 702 and 703 forming a close loop.(as viewed in FIG.9).

The Handles 701 are connected to the Arm elastic cord 201 and 202 by a pair of Snap links 704.

The Handles 701 are connected to the user by the user's hands.

What is claim is:

1. An exercise device comprising a door attachment member, said door attached assembly having a first end and a second end, a pair of first elastic cord members each having a first end and a second end, said first elastic members having a first predetermined length and wherein each of the first ends of said first elastic members are attached to a second end of said door attachment member, an arm adjustable extension assembly, having a first end and a second end, the first end of said arm adjustable extension strap assembly being connected to the second end of said door attachment member, a pair of second elastic cord members each having a firs end a second end, said second elastic members each having a second length which is shorter than said first length of said pair of said first elastic members, said first ends of said second pair of elastic members being attached to said second end of said arm adjustable extension strap and, wherein said attachment means is attached to each of the second ends of the first and second pairs of said elastic cord members.

2. The exercise device of claim 1 wherein the first end of said door attachment member is a closed loop means, for connecting to a closed door.

3. The exercise device of claim 1 wherein said pair of first elastic cord members include adjustable connectors connecting said second ends of said first elastic cord members to said respective limb attachment means.

4. The device of claim 3 wherein said adjustable connectors comprise:

a strap and a locking slide and is capable of being selectively adjustable and may be locked in place by said locking slide.

5. The exercise apparatus of claim 1 wherein said limb attachment means of said second pair of said elastic cord members are soft flexible straps having multifunctional use an are capable of being attached t a users feet ankles, knees, hips, chest or head.

* * * * *